US005107638A

United States Patent [19]

Unertl

[11] Patent Number: 5,107,638

[45] Date of Patent: Apr. 28, 1992

[54] MOUNTING MEANS FOR WALL-MOUNTED WATER CLOSET FIXTURES

[76] Inventor: James L. Unertl, P.O. Box 381984, Jacksonville, Fla. 32238

[21] Appl. No.: 641,663

[22] Filed: Jan. 15, 1991

[51] Int. Cl.[5] ..... E03D 11/00

[52] U.S. Cl. ..... 52/35; 4/252 R

[58] Field of Search ..... 4/252 R; 52/35, 34

[56] References Cited

U.S. PATENT DOCUMENTS 4,979,239 12/1990 Klein ..... 4/252 R

FOREIGN PATENT DOCUMENTS 2751715 5/1979 Fed. Rep. of Germany ..... 4/252 R 2809135 9/1979 Fed. Rep. of Germany ..... 4/252 R 3410499 8/1985 Fed. Rep. of Germany ..... 4/252 R 597802 9/1959 Italy ..... 4/252 R

*Primary Examiner*—John E. Murtagh

*Attorney, Agent, or Firm*—Thomas C. Saitta

[57] ABSTRACT

Mounting means for securing a wall-mounted water closet fixture having an upper inlet conduit comprising in combination a vertical brace member rigidly attached to a floor-mounted fixture carrier, said brace member being also rigidly attached to said upper inlet conduit, therefore providing a second point of attachment for said fixture which prevents unwanted movement of the upper portion of said fixture.

4 Claims, 1 Drawing Sheet

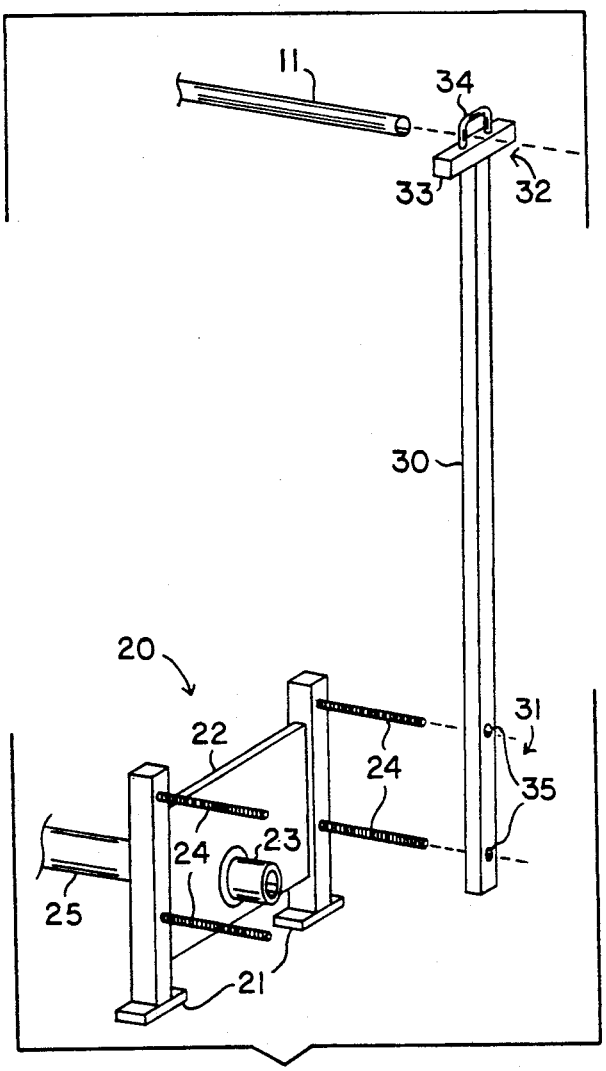
FIG. 1
FIG. 2
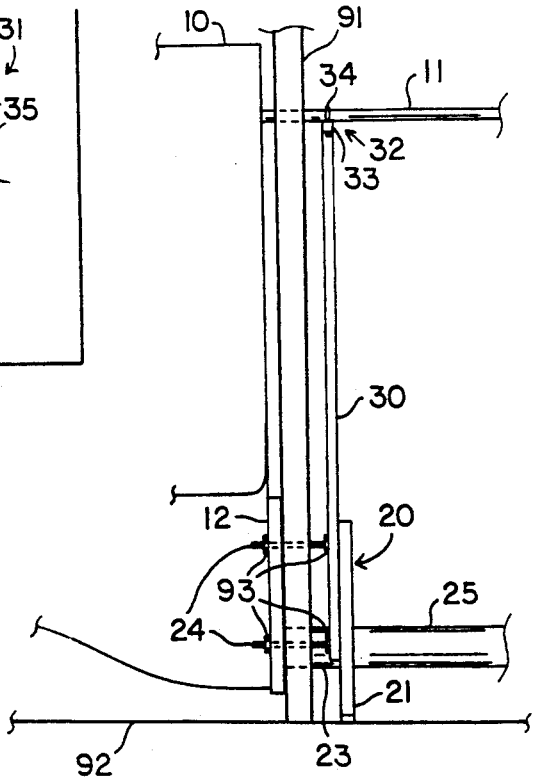

MOUNTING MEANS FOR WALL-MOUNTED WATER CLOSET FIXTURES

BACKGROUND OF THE INVENTION

This invention relates generally to the field of mounting means for wall-mounted water closet fixtures, and more particularly to the field of mounting means comprising floor-mounted fixture carriers for attachment of wall-mounted fixtures having upper inlet conduits and lower mounting means.

In many circumstances it is preferable to mount water closet fixtures such as toilets or urinals directly to the wall of a structure rather to the floor. Typically, a fixture carrier comprising a bracket retaining the connector conduit is directly mounted on or in the floor at a location internal to the wall to which the fixture will be mounted. The wall-mounted fixture has mounting means which connect directly to the floor-mounted fixture carrier with the wall in between. This lower mounting means is the only structural connection to the floor of the room, and is therefore the sole means of support for the fixture. An upper conduit extends through the wall and is attached to the upper portion of the fixture to supply water. It is common practice to secure this upper conduit to the studs of the wall by brackets.

Because the point of attachment for the wall-mounted fixture is at the bottom and to the side rather than directly beneath the fixture, there is a tendency over time for the fixture to develop a significant amount of play, either from misuse or merely because of the weight effects of the indirect mounting. The upper portion of the fixture develops a range of free motion and loosens the connecting brackets retaining the upper inlet conduit. This bracket is not of sufficient strength to prevent this from occurring. The motion of the fixture results in movement of the inlet conduit which creates noise, and can lead to damage to the wall or to the conduit joints.

The invention solves the problems set forth above by providing brace means connecting the inlet conduit pipe directly to the floor-mounted fixture carrier. The brace means is fixedly attached to the conduit pipe. Rather than merely being secured in an off-center manner at its lower end, the wall-mounted fixture is now secured at both its lower end and at its upper end. This attachment at the upper end prevents motion of the usually free upper portion of the fixture.

The invention also solves another problem present with the standard system now in use for wall-mounted fixtures. In new construction, a plumber sets out the lower conduits and fixture carrier prior to the construction of the wall studs. After another crew has put in the wall studs, the plumber must return and place the upper inlet conduit at the proper height for attachment to the fixture. With the invention, the brace member is a predetermined length so that the point of attachment for the inlet conduit is at the proper height for the fixture. Thus a plumber can set up the inlet conduit at the same time as the fixture carrier is installed, since the wall studs are not needed.

BRIEF SUMMARY OF THE INVENTION

The invention comprises a vertical brace member used in combination with a floor-mounted fixture carrier. The brace member has lower attachment means for direct attachment of the brace to the fixture carrier, and upper attachment means for connection to the upper inlet conduit of a wall-mounted water closet fixture. Since the upper conduit is attached to the upper portion of the fixture, the brace member provides direct support to the upper portion of the fixture because of its rigid connection to the secured fixture carrier mounted on or in the floor itself.

A standard fixture carrier has four fixture mounting studs, usually threaded rods, which are long enough to extend through the wall itself. Corresponding apertures are placed in the lower mounting means of the fixture and the fixture is secured to the fixture carrier by nuts tightened onto the mounting studs. The brace member preferably comprises an elongated vertical member which is apertured at its lower end to correspond to two of the mounting studs. The brace member is slipped onto the mounting studs and nuts are used to fixedly attach it to the fixture carrier. The upper end of the vertical member culminates in attachment means, such as a clamp, for securing the brace member to the upper inlet conduit, which is usually a small copper pipe. In this manner the wall-mounted fixture is secured to the fixture carrier, and thus to the floor, at both its lower and upper portion.

BRIEF DESCRIPTION OF THE DRAWINGS

FIG. 1 is an expanded perspective view of the invention.

FIG. 2 is a side view of the invention as positioned in use.

DETAILED DESCRIPTION OF THE INVENTION

With reference to the figures, the invention will now be described in greater detail. In general, the invention is a mounting means for securely mounting a wall-mounted water closet fixture 10, such as a toilet or an urinal, so that movement of the fixture 10 is minimized. This is accomplished by providing a point of attachment which ties in the fixture 10 at its upper portion, which is in addition to the usual solitary point of attachment at its lower portion. As seen in FIG. 2, a fixture carrier 20 is attached directly onto or is embedded into the floor 92 in the known manner. This attachment must be of sufficient strength and rigidity to compensate for the weight of the fixture 10, the fixture 10 being mounted to the side of fixture carrier 20. The fixture carrier 20 is positioned so as to be on the interior side of wall 91 while the fixture 10 itself is mounted on the opposite side of the wall 91.

The fixture carrier 20 comprises two or more legs 21 with a spanning carrier plate 22 which retains a connector fitting or sleeve 23 communicating to the outlet conduit 25. Fixture connection means usually comprising a number of mounting studs 24, usually four threaded rods, extend from the fixture carrier 20 and are of sufficient length to extend through wall 91. The wall-mounted fixture 10 has a lower mounting means usually comprising an apertured flange 12, the apertures corresponding to the mounting studs 24 such that the fixture 20 can be mounted so as to be flush with wall 91 by positioning flange 12 onto the mounting studs 24 and securing the two elements by nuts 93.

The water supply for fixture 10 is provided through an upper inlet conduit 11, usually a copper pipe of relatively small diameter, which passes through wall 91 and is connected to the upper portion of fixture 10. Water enters fixture 10 through the inlet conduit 11 and exits from the bottom of fixture 10 into the connector fitting 23 and then through the outlet conduit 25.

To secure the upper portion of fixture 10, a vertical brace member 30 rigidly connects the upper inlet conduit 11 to the fixture carrier 20 mounted to the floor 92. Vertical brace member 30 has lower attachment means 31 for attaching brace member 30 to fixture carrier 20, and upper attachment means 32 for attaching brace member 30 to inlet conduit 11. Brace member 30 must be of sufficient rigidity and strength such that the inlet conduit 11 cannot move relative to fixture carrier 20. Preferably, brace member 30 is a square cross-section steel metal tube, although a solid bar or tube of other configuration can also be utilized. The lower attachment means 31 for attachment of the brace member 30 to the fixture carrier 20 are two apertures 35 positioned to correspond to mounting studs 24 of fixture carrier 20. Brace member 30 is fixedly attached to the fixture carrier 20 by sliding it onto the mounting studs 24 and using nuts 93 to securely fasten it. Brace member 30 will thus extend vertically above fixture carrier 20, its upper end corresponding to the location of inlet conduit 11. Upper attachment means 32 can be any suitable fastening means which provides a fixed and secure connection to inlet conduit 11. For example, upper attachment means 32 can comprise a horizontal member 33 and a U-bolt clamp 34 fastened around inlet conduit 11, as shown in the figures.

With the brace member 30 in place and securely attached to the fixture carrier 20 and the inlet conduit 11, the fixture 10 will be secured at its upper portion as well as its lower portion, thus preventing movement of the upper portion. This additional point of attachment is inside wall 91, and the device can be fixed in place in a single step during construction. Then after the wall is completed, the fixture 10 can be mounted onto the mounting studs 24 of fixture carrier 20 and the inlet conduit 11 connected to its upper portion.

It will be obvious to those skilled in the art that various mechanical elements may be substituted for the elements described above. For example, the lower attachment means 31 of brace member 30 could further comprise a horizontal bar member apertured to receive the mounting studs 24. Likewise, the upper attachment means 32 of brace member 30 can comprise a trough to receive the inlet conduit 11, or it can be any of other known mechanical fastening means to attach it to the brace member 30. The brace member 30 could be welded to the fixture carrier 20 or the inlet conduit 11. Therefore, the full scope and definition of the invention is to be as set forth in the following claims.

I claim:

1. Mounting means for a wall-mounted water closet fixture having an upper inlet conduit and lower mounting means, comprising in combination a floor-mounted fixture carrier and a vertical brace member, said floor-mounted fixture carrier having fixture connection means for attachment of said lower mounting means of said wall-mounted fixture, said brace member having lower attachment means for attachment of said brace member to said floor-mounted fixture carrier and having upper attachment means for attachment of said brace member to said upper inlet conduit, where said fixture connection means comprises a number of threaded mounting studs, and said lower attachment means comprises apertures in said brace member positioned to correspond to said mounting studs and nuts adapted to fit said mounting studs, were said brace member is rigidly attached to both said floor-mounted fixture carrier and said upper inlet conduit.

2. The device of claim 1, where said upper attachment means comprises an horizontal member and a clamp.

3. Mounting means for a wall-mounted water closet fixture having an upper inlet conduit, where said wall-mounted fixture is attached to a floor-mounted fixture carrier, comprising a vertical brace member having lower attachment means for rigidly attaching said brace member to said fixture carrier and upper attachment means for rigidly attaching said brace member to said upper inlet conduit, where said floor-mounted fixture carrier has a number of threaded mounting studs, and said lower attachment means comprises apertures corresponding in position to said mounting studs and nuts adapted to fit said mounting studs.

4. The device of claim 3, where said upper attachment means comprises a horizontal member and a clamp.

* * * * *